US010676897B2

(12) United States Patent
Oka et al.

(10) Patent No.: US 10,676,897 B2
(45) Date of Patent: Jun. 9, 2020

(54) CONSTRUCTION MACHINE

(71) Applicant: Hitachi Construction Machinery Tierra Co., Ltd., Koka-shi, Shiga (JP)

(72) Inventors: Daisuke Oka, Yasu (JP); Hajime Yoshida, Omihachiman (JP); Yoshifumi Takebayashi, Koka (JP); Natsuki Nakamura, Koka (JP)

(73) Assignee: Hitachi Construction Machinery Tierra Co., Ltd, Koka-shi (JP)

( * ) Notice: Subject to any disclaimer, the term of this patent is extended or adjusted under 35 U.S.C. 154(b) by 0 days.

(21) Appl. No.: 16/277,533

(22) Filed: Feb. 15, 2019

(65) Prior Publication Data

US 2019/0292753 A1 Sep. 26, 2019

(30) Foreign Application Priority Data

Mar. 26, 2018 (JP) ..... 2018-058940

(51) Int. Cl.
*F15B 11/10* (2006.01)
*E02F 9/22* (2006.01)
(Continued)

(52) U.S. Cl.
CPC ..... *E02F 9/2225* (2013.01); *E02F 3/425* (2013.01); *E02F 3/963* (2013.01); *E02F 9/2004* (2013.01);
(Continued)

(58) Field of Classification Search
CPC ..... F15B 2211/45; F15B 2211/3056; F15B 2211/6309; F15B 2211/6313; F15B 11/10;
(Continued)

(56) References Cited

U.S. PATENT DOCUMENTS 5,134,853 A * 8/1992 Hirata ..... E02F 9/2225 60/420
5,148,676 A * 9/1992 Moriya ..... E02F 9/2242 60/422

(Continued)

FOREIGN PATENT DOCUMENTS

JP 2005-336849 A 12/2005
KR 10-2012-0137343 A 12/2012
KR 10-2014-0050087 A 4/2014

OTHER PUBLICATIONS

Korean-language Office Action issued in Korean Application No. 10-2019-0004479 dated Feb. 3, 2020 with an English translation (nine (9) pages).

*Primary Examiner* — Thomas E Lazo
(74) *Attorney, Agent, or Firm* — Crowell & Moring LLP

(57) ABSTRACT

A construction machine that can easily regulate a set maximum flow rate at a time of replacement of an attachment and that can improve an energy conservation performance is provided. A controller selects a corresponding map in response to an attachment designation signal from among maps each of which sets a relationship between an operation signal per type of the attachment and a flow rate of a hydraulic fluid supplied to an actuator, generates a control signal by causing the selected map to refer to the operation signal, and controls a flow control valve of an attachment flow rate regulation valve device in such a manner that a position of the flow control valve is switched over from a neutral position on the basis of the control signal. An unloading valve that maintains a differential pressure across the flow control valve is disposed in the attachment flow rate regulation valve device.

3 Claims, 7 Drawing Sheets

(51) Int. Cl.

| | |
|---|---|
| ***E02F 3/96*** | (2006.01) |
| ***E02F 9/20*** | (2006.01) |
| ***E02F 3/42*** | (2006.01) |
| ***F15B 11/17*** | (2006.01) |
| *E02F 3/32* | (2006.01) |

(52) U.S. Cl.
CPC ..... *E02F 9/2235* (2013.01); *E02F 9/2242* (2013.01); *E02F 9/2267* (2013.01); *E02F 9/2271* (2013.01); *E02F 9/2282* (2013.01); *E02F 9/2292* (2013.01); *F15B 11/10* (2013.01); *F15B 11/17* (2013.01); *E02F 3/32* (2013.01); *E02F 9/2285* (2013.01); *E02F 9/2296* (2013.01); *F15B 2211/20576* (2013.01); *F15B 2211/45* (2013.01); *F15B 2211/7053* (2013.01)

(58) Field of Classification Search
CPC ..... E02F 9/2242; E02F 9/2235; E02F 9/2225; E02F 9/2246; E02F 9/2228; E02F 9/2285
See application file for complete search history.

(56) References Cited

U.S. PATENT DOCUMENTS

| | | | | |
|---|---|---|---|---|
| 6,522,964 | B1 * | 2/2003 | Miki | E02F 9/205 172/315 |
| 7,441,407 | B2 * | 10/2008 | Sawada | E02F 9/2225 60/431 |
| 8,438,843 | B2 * | 5/2013 | Ueda | E02F 9/2242 60/328 |
| 9,784,368 | B2 * | 10/2017 | Matsuzaki | E02F 3/32 |
| 2012/0291427 | A1 | 11/2012 | Azuma et al. | |
| 2014/0196793 | A1 | 7/2014 | Matsuzaki | |

* cited by examiner

CONSTRUCTION MACHINE

BACKGROUND OF THE INVENTION

1. Field of the Invention

The present invention relates to a construction machine and particularly relates to a construction machine such as a hydraulic excavator provided with an attachment flow rate regulation valve device that regulates a flow rate of a hydraulic fluid supplied to an actuator for an attachment other than a bucket when the attachment is attached to a front work implement.

2. Description of the Related Art

A hydraulic excavator configured with an upper swing structure and a lower track structure includes many hydraulic actuators such as hydraulic cylinders for operating a boom, an arm, a bucket, and the like that configure a front work implement to rotate and a travel motor for driving left and right crawler belts, and mounts therein a plurality of variable displacement hydraulic pumps for freely driving these actuators.

Furthermore, a crusher (crushing machine), a hydraulic breaker, a rotary tilt bucket, a full circle slewing fork grapple, or the like is attached to the front work implement as an alternative to the bucket attached thereto and work other than excavation work such as crushing work on structures or crushing work on rocks is often conducted. These attachments, unlike the ordinary bucket, include actuators unique to the attachments and a demanded flow rate varies depending on attachment specifications of the attachments. For example, in a case of driving the crusher, a required flow rate corresponds to flow rates of hydraulic fluids delivered from two pumps, and in a case of driving the hydraulic breaker, a required flow rate corresponds to a flow rate of a hydraulic fluid delivered from one pump. On the other hand, in a case of driving the rotary tilt bucket or a swing section of the full circle slewing fork grapple, a flow rate sufficient for driving the rotary tilt bucket or the swing section can be obtained by a flow rate that is half of the flow rate of the hydraulic fluid delivered from one pump.

In many cases, attachments of the hydraulic excavator are replaced depending on necessary work. Therefore, a demand rises that the flow rate of the hydraulic fluid supplied to each attachment can be arbitrarily regulated in the hydraulic excavator so that the hydraulic excavator can be instantly adaptive to the attachment attached to the front work implement.

To address such a demand, a technique described in JP-2005-336849-A is known.

According to the technique described in JP-2005-336849-A, a hydraulic drive system of a construction machine includes an attachment flow rate switching device disposed between a control valve for an attachment in a delivery circuit of a hydraulic pump and an actuator for the attachment.

The attachment flow rate switching device includes a maximum flow rate cut valve that switches over a flow rate of a hydraulic fluid to either a high flow rate or a low flow rate depending on a flow rate necessary for the actuator, and the maximum flow rate cut valve has a hydraulic line that supplies the hydraulic fluid at the flow rate output from the control valve for the attachment to the actuator for the attachment, valve means that cuts a maximum flow rate of the hydraulic fluid flowing in this hydraulic line, and operation switching means that deactivates a function of the valve means when the flow rate of the hydraulic fluid to the attachment is operated to the high flow rate side, and that activates the function of the valve means when the flow rate of the hydraulic fluid to the attachment is operated to the low flow rate side.

The valve means has a throttle installed in the hydraulic line and a spring actuated in a closing direction, and has a bypass valve that is closed by a force of the spring when a differential pressure across the throttle is equal to or lower than a set value specified by the spring, and that is opened when the differential pressure across the throttle exceeds the set value specified by the spring to bypass the hydraulic fluid in the hydraulic line to a return circuit. The operation switching means includes, for example, an electrical switch as operation means, and is configured to keep the bypass valve in a closed state when this electrical switch is operated to a high flow rate side and to cancel keeping the bypass valve in the closed state when the electrical switch is operated to the low flow rate side.

Furthermore, the bypass valve of the valve means can regulate a magnitude of the flow rate when the electrical switch is operated to the low flow rate side (flow rate of the hydraulic fluid supplied to the actuator for the attachment) by arbitrarily regulating a strength of the spring.

However, the technique described in JP-2005-336849-A has the following problems.

According to the technique described in JP-2005-336849-A, the flow rate of the hydraulic fluid supplied to the actuator for the attachment can be switched over by the electrical switch between two stages that is the high flow rate and the low flow rate, and a set maximum flow rate at a time of replacement of the attachment can be regulated easily in a short period of time.

However, with the technique described in JP-2005-336849-A, in a case in which the actuator for the attachment is an actuator that requires a low flow rate and the electrical switch of the operation switching means is operated to the low flow rate side to set the valve means of the maximum flow rate cut valve to the low flow rate, the throttle installed in the hydraulic line functions to generate a fixed throttle pressure loss, to cause the differential pressure across the throttle to act on the bypass valve of the valve means, and to supply only the hydraulic fluid at a fixed flow rate to the actuator for the attachment. At this time, because of installation of a throttle also in a hydraulic line on a non-hydraulic fluid supply side (discharge side) of the actuator, an unnecessary back pressure is generated to increase a load pressure of the hydraulic pump and to deteriorate an energy conservation performance.

Moreover, in a case in which the actuator that requires a high flow rate is attached and the electrical switch of the operation switching means is operated to the high flow rate side, the hydraulic fluid output from the control valve for the attachment passes through the throttle installed in the hydraulic line since the bypass valve is not actuated. As a result, the unnecessary throttle pressure loss and the load pressure of the hydraulic pump increase and the energy conservation performance is deteriorated.

SUMMARY OF THE INVENTION

The present invention has been achieved in the light of the problems described above and an object of the present invention is to provide a construction machine that can regulate a set maximum flow rate at a time of replacement of an attachment easily in a short period of time and that can improve an energy conservation performance.

To attain the object, there is provided a construction machine including: a first hydraulic pump; a first selector valve of a center bypass type to which a hydraulic fluid delivered from the first hydraulic pump is introduced; an actuator for an attachment, the actuator being driven by the hydraulic fluid having passed through the first selector valve; and an operation device that instructs an operation of the attachment, wherein the construction machine comprises: an attachment flow rate regulation valve device having a hydraulic line connected to the first selector valve, a flow control valve of a closed center type connected to the hydraulic line and configured to regulate a flow rate of the hydraulic fluid passing through the first selector valve and supply the hydraulic fluid to the actuator, and an unloading valve connected to the hydraulic line and configured to unload the hydraulic fluid flowing through the hydraulic line while maintaining a differential pressure across the flow control valve; an attachment designation device that designates a type of the attachment; an operation switching device configured to switch over a position of the first selector valve to a full open position when the operation device is operated; and a controller configured to control the flow control valve on the basis of an operation signal output from the operation device and an attachment designation signal output from the attachment designation device, the unloading valve being a selector valve that moves between a closed position and an open position, the selector valve having, at an end portion of a side in which the unloading valve is actuated in a closing direction, a pressure receiving section to which a load pressure of the actuator is introduced and a spring, and having, at an end portion of a side in which the unloading valve is actuated in an opening direction, a pressure receiving section to which a pressure from the hydraulic line is introduced, the controller being configured to select a corresponding map in response to the attachment designation signal from maps which are stored in the controller and each of which sets a relationship between the operation signal per type of the attachment and the flow rate of the hydraulic fluid supplied to the actuator, to generate a control signal by causing the selected map to refer to the operation signal, and to control the flow control valve in such a manner that a position of the flow control valve is switched over from a neutral position on the basis of the control signal.

In this way, by selecting the corresponding map in response to the attachment designation signal output from the attachment designation device from maps which are stored in the controller and each of which sets the relationship between the operation signal per type of the attachment and the flow rate of the hydraulic fluid supplied to the actuator, generating the control signal by causing the selected map to refer to the operation signal, and controlling the flow control valve of the attachment flow rate regulation valve device in such a manner that the position of the flow control valve is switched over from the neutral position on the basis of the control signal, regulation of the set maximum flow rate for the attachment is enabled only by operator's operating the attachment designation device to designate the type of the attachment. It is therefore possible to regulate the set maximum flow rate at the time of replacement of the attachment easily in a short period of time, instantly adapt to the replacing attachment, and perform replacement of the attachment including regulation of the set maximum flow rate promptly and easily.

Furthermore, the hydraulic drive system is configured such that a special throttle is not installed in the hydraulic line of the attachment flow rate regulation valve device and that the unloading valve unloads the hydraulic fluid flowing in the hydraulic line, maintains the differential pressure across the flow control valve, and controls the flow rate. Thus, in a case in which the maximum flow rate of the hydraulic fluid supplied to the actuator for the attachment such as a rotary tilt bucket is sufficient to be approximately half of the maximum delivery flow rate of the hydraulic fluid delivered from the first hydraulic pump, the hydraulic fluid discharged from the actuator for the attachment is merely returned to a tank by way of the flow control valve, a load pressure of the first hydraulic pump does not increase without generation of an unnecessary back pressure, and an energy conservation performance is not deteriorated. Moreover, in a case in which the actuator for the attachment such as a hydraulic breaker requires a flow rate that is approximately equal to the maximum delivery flow rate of the hydraulic fluid delivered from the first hydraulic pump, the hydraulic fluid supplied from the first hydraulic pump passes through the flow control valve (full open) of the attachment flow rate regulation valve device and is only supplied to the actuator. In this case, an unnecessary throttle pressure loss is not generated and the energy conservation performance can be improved.

According to the present invention, it is possible to regulate the set maximum flow rate at the time of replacement of the attachment easily in a short period of time and improve the energy conservation performance.

DESCRIPTION OF THE PREFERRED EMBODIMENT

A construction machine according to one embodiment of the present invention will be described hereinafter on the basis of the drawings.

A hydraulic excavator that is a representative example of the construction machine according to the embodiment of the present invention will first be described on the basis of FIG. 1.

Figure 1:
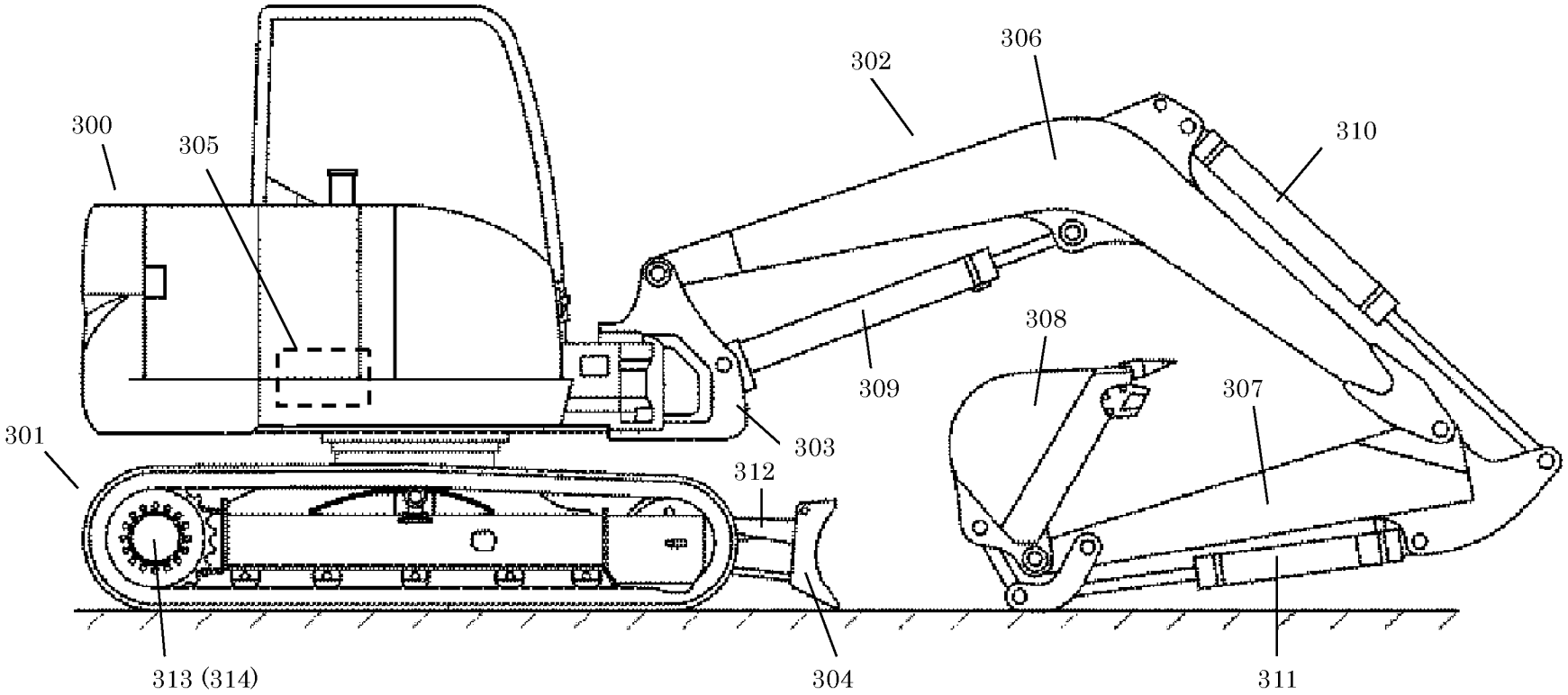
FIG. 1 depicts an outward appearance of a hydraulic excavator that is a representative example of a construction machine according to one embodiment of the present invention.

As depicted in FIG. 1, the hydraulic excavator includes a swing structure 300 that configures a machine body and a track structure 301. In addition, the hydraulic excavator includes a work device, that is, a front work implement 302 that conducts soil excavation work. The front work implement 302 includes a boom 306, an arm 307, and a bucket 308. The swing structure 300 is driven by a swing motor 305 to swing on the track structure 301. The front work implement 302 described above is attached to a swing post 303 of this swing structure 300 in such a manner as to be vertically rotatable. The front work implement 302 operates the boom 306, the arm 307, and the bucket 308 to rotate by expanding and contracting a boom cylinder 309 that drives the boom 306, an arm cylinder 310 that drives the arm 307, and a bucket cylinder 311 that drives the bucket 308. A blade 304 that vertically moves by expansion and contraction of a blade cylinder 312 is attached to the track structure 301, and the track structure 301 is driven by a right travel motor 313 and a left travel motor 314 to travel.

The hydraulic excavator of this type often conducts work by attaching an attachment such as a crusher (crushing machine) or a breaker as an alternative to the bucket 308. In this case, an actuator for the attachment, which will be hereinafter referred to as "attachment actuator," for actuating a movable section of the attachment is provided in the attachment.

Figure 2:
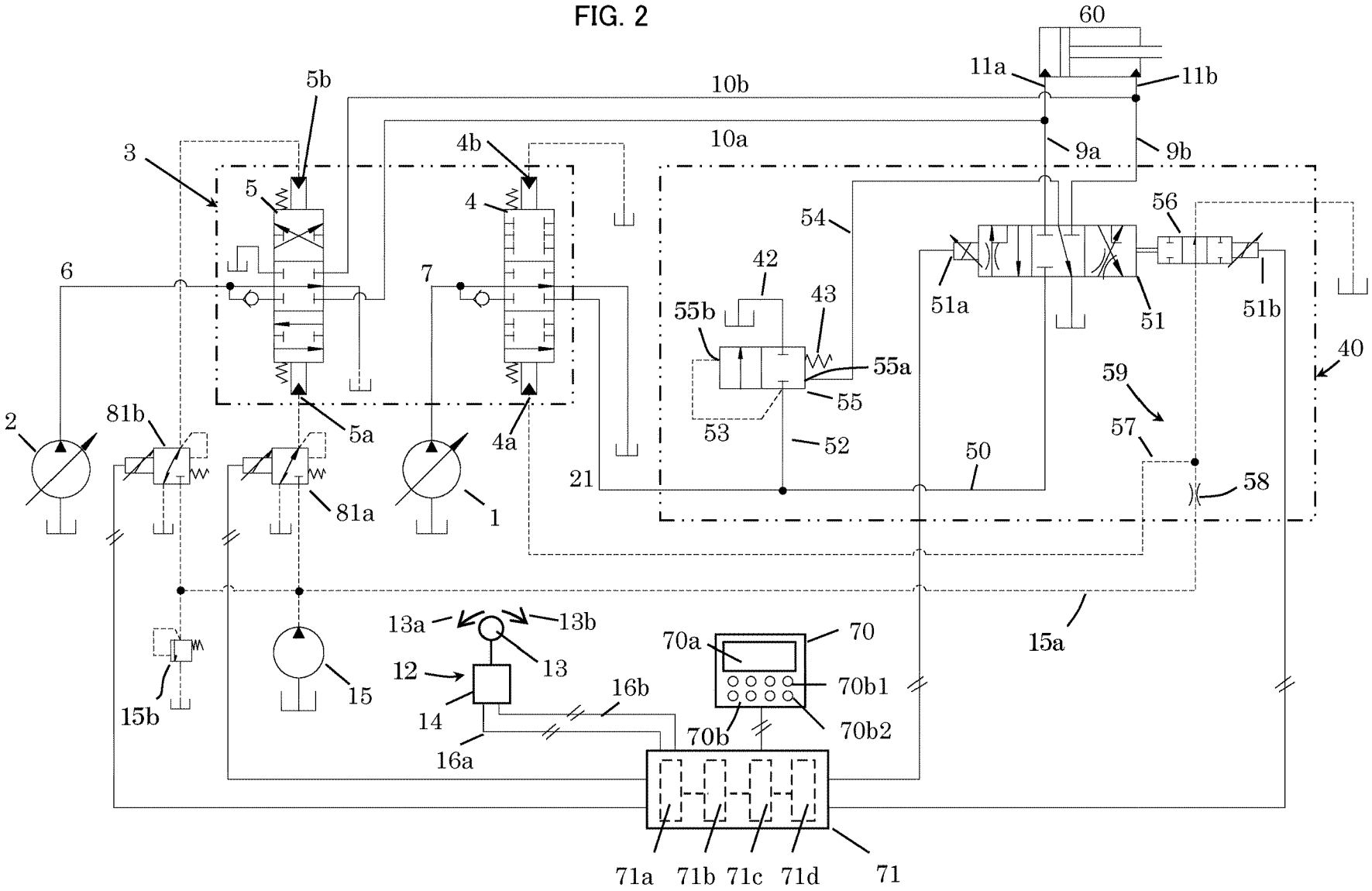
FIG. 2 is a system configuration diagram of a hydraulic drive system mounted in the hydraulic excavator according to the embodiment of the present invention.

FIG. 2 is a system configuration diagram of a hydraulic drive system mounted in the hydraulic excavator according to the embodiment of the present invention.

In FIG. 2, the hydraulic drive system mounted in the hydraulic excavator according to the present embodiment includes a main pump (first hydraulic pump) 1 of a variable displacement type, a main pump (second hydraulic pump) 2 of a variable displacement type, a control valve 3 to which hydraulic fluids delivered from the main pumps 1 and 2 are supplied, and an actuator 60 to which the hydraulic fluids delivered from the main pumps 1 and 2 by way of the control valve 3 are supplied.

The control valve 3 includes a flow control valve (first selector valve) 4 connected to the main pump 1 via a hydraulic fluid supply line 7 and a flow control valve (second selector valve) 5 connected to the main pump 2 via a hydraulic fluid supply line 6.

The flow control valves 4 and 5 of the control valve 3 are each a selector valve of a six-port, three-position center bypass type, and an actuator port of the flow control valve 4 is connected to the actuator 60 via an actuator line 21, an attachment flow rate regulation valve device 40 (to be described later), actuator lines 9*a* and 9*b*, and merging lines 11*a* and 11*b*. An actuator port of the flow control valve 5 is connected to the actuator lines 9*a* and 9*b* via actuator lines 10*a* and 10*b*, and further connected to the actuator 60 via the merging lines 11*a* and 11*b*. Furthermore, the flow control valves 4 and 5 are hydraulic pilot switching type valves and provided with pilot pressure receiving sections 4*a* and 4*b* and 5*a* and 5*b* on two ends of each of the flow control valves 4 and 5. The pilot pressure receiving section 4*a* of the flow control valve 4 is connected to a signal pressure line 57 (to be described later) and the pilot pressure receiving section 4*b* is connected to a tank. The pilot pressure receiving sections 5*a* and 5*b* of the flow control valve 5 are connected to a pilot pressure line 15*a*, to which a hydraulic fluid delivered from a pilot pump 15 is supplied, via solenoid proportional pressure reducing valves 81*a* and 81*b* (to be described later), respectively.

The actuator 60 is an attachment actuator, which is an actuator for an attachment, for example, a crusher or a breaker. The attachment is attached as an alternative to the bucket 308 depicted in FIG. 1, and examples of the attachment that can replace the bucket 308 include a rotary tilt bucket and a full circle slewing fork grapple in addition to the crusher and the breaker.

The hydraulic drive system mounted in the hydraulic excavator according to the present embodiment includes an operation device 12 of an electric lever type that serves as an operation device instructing an operation of such an attachment. The operation device 12 has an operation lever 13 and a signal generation section 14 that generates an electrical signal in response to an operation direction 13*a* or 13*b* and an operation amount of the operation lever 13 and that outputs the electrical signal to signal lines 16*a* and 16*b*.

It is noted that in FIG. 2 the other actuators such as the travel motors 313 (314), the swing motor 305, the boom cylinder 309, and the arm cylinder 310, flow control valves of the other actuators connected to the hydraulic fluid supply lines 6 and 7, and operation devices for these other actuators are omitted to avoid cumbersomeness of illustration and explanation.

Moreover, the hydraulic drive system mounted in the hydraulic excavator according to the present embodiment includes, as characteristic configurations, the attachment flow rate regulation valve device 40 disposed between the actuator line 21 and the actuator lines 9*a* and 9*b*, a monitor device 70 that plays a role as an attachment designation device designating a type of the attachment, and a controller 71.

The attachment flow rate regulation valve device 40 has a hydraulic line 50 that is connected to the actuator port of the flow control valve 4 via the actuator line 21, a flow control valve 51 of a closed center type that is connected to the hydraulic line 50, that regulates a flow rate of the hydraulic fluid passing through the flow control valve 4, and that supplies the hydraulic fluid to the actuator 60 via either the actuator line 9*a* or 9*b*, and an unloading valve 55 that is disposed in the hydraulic line 50 and that unloads the hydraulic fluid flowing in the hydraulic line 50 to maintain a differential pressure across the flow control valve 51 to a fixed value.

The flow control valve 51 is an electrically controlled selector valve, and includes proportional solenoids 51*a* and 51*b* operating the flow control valve 51 to switch over a position of the flow control valve 51 by a magnetizing current output from the controller 71 when the operation lever 13 of the operation device 12 is operated. The flow control valve 51 has a neutral position and left and right switching positions, intercepts communication between the hydraulic line 50 and the actuator lines 9*a* and 9*b* at the neutral position, and communicates the hydraulic line 50 with the actuator lines 9*a* and 9*b* when the position of the flow control valve 51 is switched over to the left or right switching position. Furthermore, at the left or right switching position, the flow control valve 51 increases an opening area and increases the flow rate of the hydraulic fluid supplied to the actuator 60 as a stroke thereof increases (as a lever operation amount of the operation device 12 increases and the magnetizing current output from the controller 71 increases).

The unloading valve 55 is a selector valve that moves between a closed position and an open position. A pressure receiving section 55*a* to which a load pressure of the actuator 60 is introduced via a pressure signal line 54 and a spring 43 are provided on a side on which the unloading valve 55 is actuated in a closing direction, a pressure receiving section 55*b* to which a pressure of the hydraulic line 50 is introduced via a branched hydraulic line 52 and a pressure signal line 53 is provided on a side on which the unloading valve 55 is actuated in an opening direction. The unloading valve 55 operates with an urging force of the pressure receiving section 55*a* and the spring 43 and an urging force of the pressure receiving section 55*b* kept in balance, and discharges (bleeds off) the hydraulic fluid to the tank at part of a delivery flow rate delivered from the main pump 1 in such a manner that the differential pressure across the flow control valve 51 is equal to a fixed value determined by the spring 43.

A bleed-off amount of the hydraulic fluid by the unloading valve 55 is determined depending on the delivery flow rate of the hydraulic fluid delivered from the main pump 1, a strength of the spring 43, and the opening area of the flow control valve 51. The following relationship is held if it is assumed that the opening area of the flow control valve 51 is A1, the differential pressure across the flow control valve 51 is ΔP1, and a pass-through flow rate of the hydraulic fluid passing through the flow control valve 51 is Q1.

$$Q1=\text{constant}\times A1\times\sqrt{\Delta P1}$$

It is understood from the relationship that increasing or reducing the opening area A1 of the flow control valve 51 makes it possible to regulate the flow rate A1. In other words, the opening area A1 of the flow control valve 51 varies depending on a strength of a magnetizing current applied to the proportional solenoids 51*a* and 51*b*; thus, it is possible to control the flow rate of the hydraulic fluid supplied to the actuator 60 depending on the strength of the magnetizing current applied to the proportional solenoids 51*a* and 51*b*.

Furthermore, the attachment flow rate regulation valve device 40 also has an operation detection valve 56 provided on one end of the flow control valve 51 and a signal pressure line 57 connected to the pilot pressure receiving section 4*a* of the flow control valve 4 of the control valve 3. The operation detection valve 56 can be moved integrally with the flow control valve 51, and the proportional solenoid 51*b* is attached to an end portion of the operation detection valve 56. The operation detection valve 56 is at an open position and communicates the signal pressure line 57 with the tank when the flow control valve 51 is at a neutral position, and a position of the operation detection valve 56 is switched over to a closed position and the operation detection valve 56 intercepts communication between the signal pressure line 57 and the tank when a position of the flow control valve 51 is switched over to the left or right switching position. Furthermore, the signal pressure line 57 is connected to the pilot pressure line 15*a* to which the hydraulic fluid delivered from the pilot pump 15 is supplied via a fixed throttle 58 of the signal pressure line 57, and a pressure of the pilot pressure line 15*a* is kept at a fixed pressure by a pilot relief valve 15*b*. With such a configuration, when the flow control valve 51 is at the neutral position, the operation detection valve 56 is at the open position as depicted in FIG. 2, and the signal pressure line 57 communicates with the tank, then the pressure of the signal pressure line 57 is equal to a tank pressure, and the flow control valve 4 of the control valve 3 is kept at a neutral position as depicted in FIG. 2. When the position of the flow control valve 51 is switched over to the left or right switching position and the position of the operation detection valve 56 is switched over to the closed position, then a signal pressure is generated in the signal pressure line 57, and the position of the flow control valve 4 of the control valve 3 is switched over to a lower-side open position (full open position) of FIG. 2.

In this way, the operation detection valve 56, the signal pressure line 57, and the throttle 58 configure an operation switching device 59 that switches over the position of the flow control valve 4 (first selector valve) of the control valve 3 to the full open position when the operation lever 13 of the operation device 12 is operated.

Furthermore, when a maximum demanded flow rate for the attachment designated by an attachment designation signal output from the monitor device 70 is higher than a maximum delivery flow rate of the hydraulic fluid delivered from the main pump 1 (first hydraulic pump), the controller 71 switches over the position of the flow control valve 51 of the attachment flow rate regulation valve device 40 from the neutral position and, at the same time, switches over a position of the flow control valve 5 (second selector valve) of the control valve 3 to a full open position.

In other words, in a case in which a flow rate corresponding to flow rates of hydraulic fluids delivered from two pumps is required for the attachment, for example, the crusher, the hydraulic fluid delivered from the main pump 2 is introduced to the merging lines 11*a* and 11*b* by switchover of the position of the flow control valve 5 in the control valve 3, the hydraulic fluid delivered from the main pump 2 is merged with that from the main pump 1, and the merged hydraulic fluid at the flow rate is supplied to the actuator 60.

Solenoid proportional pressure reducing valves 81*a* and 81*b* are provided to switch over the position of the flow control valve 5. By operating the operation lever 13 of the operation device 12 and outputting the magnetizing current from the controller 71, the solenoid proportional pressure reducing valves 81*a* and 81*b* operate, and a control pilot pressure is introduced to the pilot pressure receiving section 5*a* or 5*b* of the flow control valve 5. The position of the flow control valve 5 is thereby switched over from the neutral position as depicted in FIG. 2, so that the hydraulic fluid delivered from the main pump 2 can be supplied to the actuator 60 in response to a lever operation amount of the operation device 12.

In this way, the controller 71 controls the flow control valve 51 of the attachment flow rate regulation valve device 40 and the flow control valves 4 and 5 of the control valve 3 on the basis of the electrical signal (operation signal) output from the operation device 12 and the attachment designation signal output from the monitor device 70 (attachment designation device).

The monitor device 70 has a display section 70*a* and an input device 70*b*, and operation keys for an operator to input a type of the attachment are arranged on the input device 70*b*.

The controller 71 includes an input section 71*a*, a computing section 71*b*, a storage section 71*c*, and an output section 71*d*, the input device 70*b* of the monitor device 70 and the signal generation section 14 (signal lines 16*a* and 16*b*) of the operation device 12 are connected to the input section 71*a* of the controller 71, and the proportional solenoids 51*a* and 51*b* of the flow control valve 51 and the solenoid proportional pressure reducing valves 81*a* and 81*b* of the flow control valve 5 are connected to the output section 71*d* of the controller 71.

A plurality of maps each setting a relationship between the electrical signal (operation signal) from the operation device 12 per type of the attachment and the flow rate of the hydraulic fluid supplied to the actuator 60 are stored in the storage section 71*c* of the controller 71. The computing section 71*b* of the controller 71 reads the corresponding map or maps from among the plurality of maps stored in the storage section 71*c* in response to the attachment designation signal output from the monitor device 70, generates a corresponding control signal by causing this read map to refer to the electrical signal (operation signal) from the operation device 12, and exercises control to switch over the position of the flow control valve 51 or the positions of the flow control valves 51 and 5 from the neutral position(s) on the basis of this control signal.

Examples of the plurality of maps stored in the storage section 71*c* will be described with reference to FIGS. 3, 4, 5A, 5B, and 6. FIGS. 3, 4, 5A, 5B, and 6 depict maps each setting the relationship between the lever operation amount (hereinafter, simply referred to as "operation amount") of the operation device 12 and the flow rate of the hydraulic fluid supplied to the actuator 60. In each of FIGS. 3, 4, 5A, 5B, and 6, a horizontal axis indicates the operation amount, and a vertical axis indicates the flow rate. Furthermore, these maps are set in such a manner that the flow rate increases as the operation amount increases and that the flow rate is equal to a maximum flow rate when the operation amount comes close to a maximum operation amount.

Figure 3:
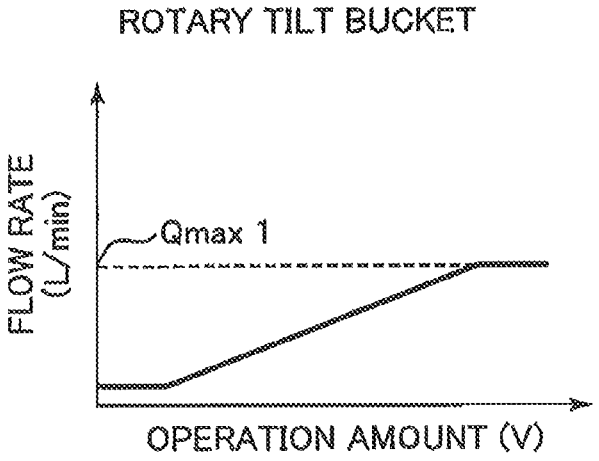
FIG. 3 depicts a map which is stored in a storage section of a controller in a case in which a maximum demanded flow rate for an attachment is relatively low like a case, for example, in which the attachment is a rotary tilt bucket.

FIG. 3 depicts the map in a case in which the maximum demanded flow rate for the attachment is relatively low like a case, for example, in which the attachment is the rotary tilt bucket. In this example, a maximum flow rate Qmax1 in the map is set to a flow rate that is approximately half of the maximum delivery flow rate of the hydraulic fluid delivered from the main pump 1.

Figure 4:
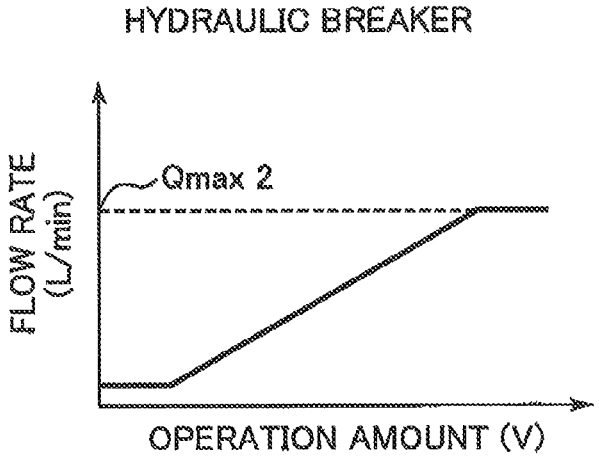
FIG. 4 depicts a map which is stored in the storage section of the controller in a case in which the maximum demanded flow rate for the attachment is slightly high like a case, for example, in which the attachment is a hydraulic breaker.

FIG. 4 depicts the map in a case in which the maximum demanded flow rate for the attachment is relatively high like a case, for example, in which the attachment is the hydraulic breaker. In this example, a maximum flow rate Qmax2 in the map is set to a flow rate that is approximately equal to the maximum delivery flow rate of the hydraulic fluid delivered from the main pump 1.

Figure 5A:
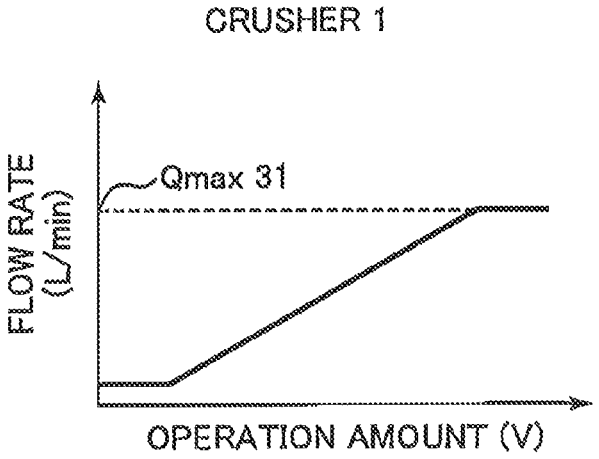
FIG. 5A depicts one of maps which are stored in the storage section of the controller in a case in which the maximum demanded flow rate for the attachment is so high that one pump cannot supply a hydraulic fluid at the demanded flow rate like a case, for example, in which the attachment is a crusher.
Figure 5B:
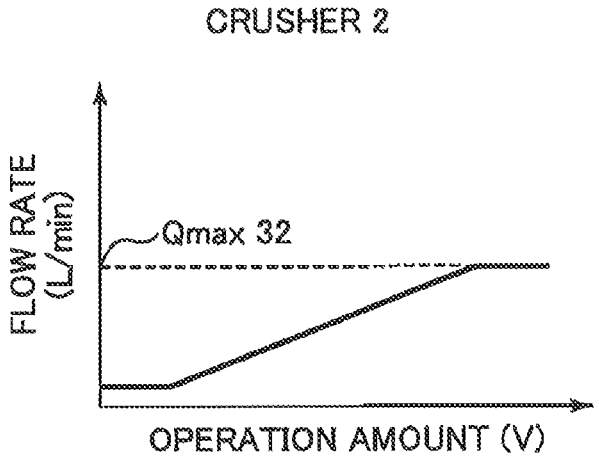
FIG. 5B depicts the other one of the maps which are stored in the storage section of the controller in the case in which the maximum demanded flow rate for the attachment is so high that one pump cannot supply the hydraulic fluid at the demanded flow rate like the case in which the attachment is the crusher.

FIGS. 5A and 5B depict the maps in a case in which the maximum demanded flow rate for the attachment is so high that one pump cannot supply the hydraulic fluid at the maximum demanded flow rate for the attachment like a case, for example, in which the attachment is the crusher. In this example, a maximum flow rate Qmax31 in the map (crusher 1) depicted in FIG. 5A is set, for example, to a flow rate that is approximately equal to a (fixed) delivery flow rate of the hydraulic fluid delivered from the main pump 2, and a maximum flow rate Qmax32 in the map (crusher 2) depicted in FIG. 5B is set to a flow rate that is approximately half of the maximum delivery flow rate of the hydraulic fluid delivered from the main pump 1.

Figure 6:
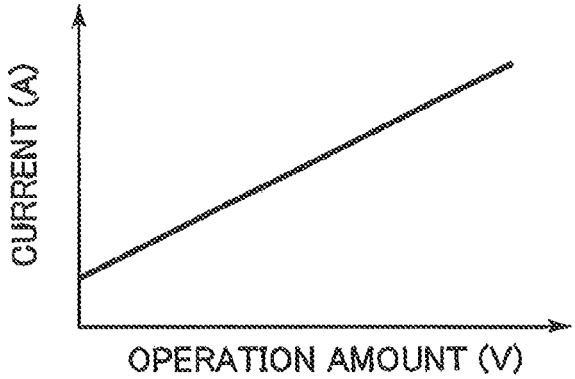
FIG. 6 depicts a map that specifies a relationship between a flow rate and a current.

FIG. 6 depicts a map that specifies a relationship between the flow rate and the current. This map is set in such a manner that the current increases as the flow rate increases. The computing section 71*b* of the controller 71 computes the flow rate using any of the maps depicted in FIGS. 3, 4, 5A, and 5B and then computes a current value corresponding to the flow rate using the map depicted in FIG. 6. The controller 71 amplifies the current value, and outputs the amplified current value to the proportional solenoids 51*a* and 51*b* of the flow control valve 51 or to the proportional solenoids 51*a* and 51*b* of the flow control valve 51 and the solenoid proportional pressure reducing valves 81*a* and 81*b* of the flow control valve 5 as the magnetizing current.

While the controller 71 computes controlled variables in an order of operation amount→flow rate→current value, the controller 71 may computes the current value directly from the operation amount. In that case, the vertical axes of the maps depicted in FIGS. 3, 4, 5A, and 5B may be replaced by the current and it is unnecessary to use the map depicted in FIG. 6.

Figure 7:
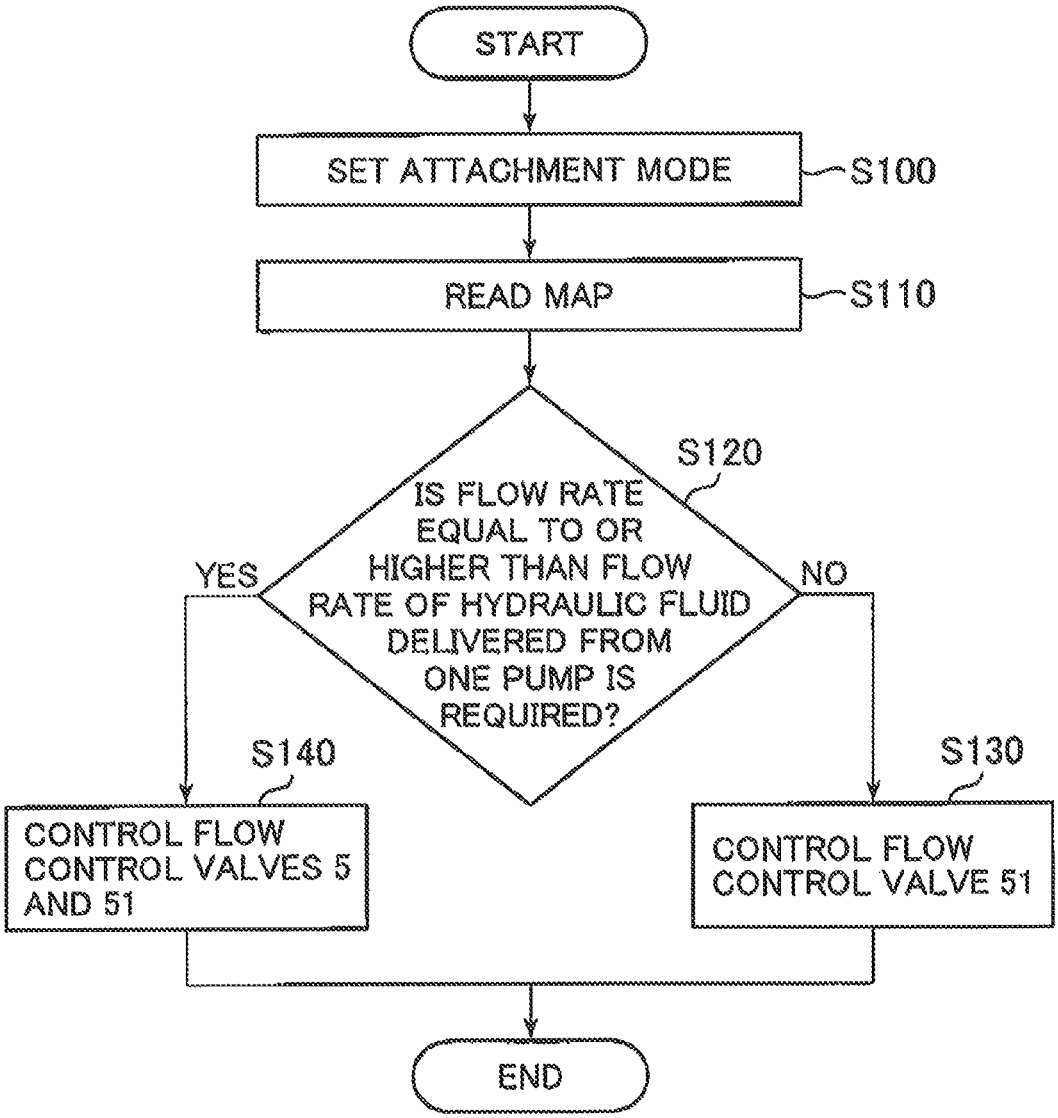
FIG. 7 is a flowchart depicting contents of processes executed by a computing section of the controller.

FIG. 7 is a flowchart depicting contents of processes executed by the computing section 71*b* of the controller 71.

First, when the operator operates the operation keys on the input device 70*b* of the monitor device 70 while viewing the display section 70*a* thereof to select an attachment mode from a mode list displayed on the display section 70*a*, and depresses an execution key, the monitor device 70 outputs an attachment mode signal. When the attachment mode signal is input to the controller 71 from the monitor device 70, the computing section 71*b* of the controller 71 sets an attachment mode, in which the flow rate can be regulated, on the basis of the attachment mode signal sent from the monitor device 70 (Step S100). Next, when the operator operates the operation keys on the input device 70*b* of the monitor device 70 while viewing the display section 70*a* thereof to select one attachment from an attachment list displayed on the display section 70*a*, and depresses the execution key, the monitor device 70 outputs an attachment designation signal. When the attachment designation signal is input to the controller 71 from the monitor device 70, the computing section 71*b* of the controller 71 reads one or a plurality of maps in response to the type of the attachment designated by the attachment designation signal from the storage section 71*c* on the basis of the attachment designation signal (Step S110). For example, the computing section 71*b* of the controller 71 reads the map depicted in FIG. 3 in a case in which the attachment designated by the attachment designation signal is the rotary tilt bucket, reads the map depicted in FIG. 4 in a case in which the attachment designated by the attachment designation signal is the hydraulic breaker, and reads the maps depicted in FIGS. 5A and 5B in a case in which the attachment designated by the attachment designation signal is the crusher.

Next, the computing section 71*b* determines whether the attachment designated by the attachment designation signal is an attachment that requires a flow rate higher than that of the hydraulic fluid delivered from one pump or an attachment that requires a flow rate equal to or lower than that of the hydraulic fluid delivered from one pump on the basis of the read map (Step S120).

In a case of determining in Step S120 that the attachment is an attachment that requires a flow rate equal to or lower than that of the hydraulic fluid delivered from one pump, the computing section 71*b* computes a flow rate by causing the map read in Step S110 (for example, the map depicted in FIG. 3 in the case in which the attachment is the rotary tilt bucket, or the map depicted in FIG. 4 in the case in which the attachment is the hydraulic breaker) to refer to the operation amount calculated from the electrical signal (operation signal) from the operation device 12, and computes a current value by further causing the map depicted in FIG.

6 to refer to the computed flow rate (Step S130). The controller 71 amplifies the current value and outputs a magnetizing current to the proportional solenoid 51*a* or 51*b* of the flow control valve 51 of the attachment flow rate regulation valve device 40. The stroke (opening area) of the flow control valve 51 is thereby controlled and the hydraulic fluid at the flow rate corresponding to the flow rate computed by the map of FIG. 3 or FIG. 4 is supplied to the actuator 60.

Furthermore, in a case of determining in Step S120 that the attachment is an attachment that requires a flow rate equal to or higher than that of the hydraulic fluid delivered from one pump, the computing section 71*b* computes a flow rate by causing the map read in Step S110 (for example, the maps depicted in FIGS. 5A and 5B in the case in which the attachment is the hydraulic crusher) to refer to the operation amount calculated from the electrical signal (operation signal) from the operation device 12, and computes a current value by further causing the map depicted in FIG. 6 to refer to the computed flow rate (Step S140). The controller 71 amplifies the current value and outputs a magnetizing current based on the map of FIG. 5A to the solenoid proportional pressure reducing valves 81*a* and 81*b* of the flow control valve 5 of the control valve 3, and outputs a magnetizing current based on the map of FIG. 5B to the proportional solenoid 51*a* or 51*b* of the flow control valve 51 of the attachment flow rate regulation valve device 40. The strokes (opening areas) of the flow control valves 5 and 51 are thereby controlled, the hydraulic fluid at the flow rate computed by the map of FIG. 5A and the hydraulic fluid at the flow rate computed by the map of FIG. 5B are merged together, and the merged hydraulic fluid at a sum of the flow rates is supplied to the actuator 60.

Next, operations in the present embodiment configured as described so far will be described while taking cases in which the attachment is the rotary tilt bucket, the attachment is the hydraulic breaker, and the attachment is the crusher by way of example.

1. Case in Which Attachment is Rotary Tilt Bucket

After replacing an attachment by the rotary tilt bucket, the operator operates the operation keys on the input device 70*b* to set the attachment mode (Step S100). Next, when the operator operates the operation keys on the input device 70*b* of the monitor device 70 while viewing the display section 70*a* thereof to select the rotary tilt bucket from the attachment list, and depresses the execution key, the computing section 71*b* of the controller 71 reads the map depicted in FIG. 3 and corresponding to the rotary tilt bucket from the storage section 71*c* on the basis of the attachment designation signal from the monitor device 70 (Step S110).

Next, when the operator operates the operation lever 13 of the operation device 12 to cause the rotary tilt bucket to swing, the operation signal is input to the controller 71. The computing section 71*b* of the controller 71 computes the current value using the operation signal and the read map depicted in FIG. 3 and the map depicted in FIG. 6 (Step S130), and the controller 71 outputs the magnetizing current corresponding to the current value to the proportional solenoid 51*a* or 51*b* of the flow control valve 51 of the attachment flow rate regulation valve device 40. The stroke (opening area) of the flow control valve 51 is thereby controlled, the hydraulic fluid at the flow rate corresponding to the flow rate computed by the map of FIG. 3 is supplied to the actuator 60, and the rotary tilt bucket swings.

2. Case in Which Attachment is Hydraulic Breaker

After replacing an attachment by the hydraulic breaker, the operator operates the operation keys on the input device 70*b* to set the attachment mode (Step S100). Next, when the operator operates the operation keys on the input device 70*b* of the monitor device 70 while viewing the display section 70*a* thereof to select the hydraulic breaker from the attachment list, and depresses the execution key, the computing section 71*b* of the controller 71 reads the map depicted in FIG. 4 and corresponding to the hydraulic breaker from the storage section 71*c* on the basis of the attachment designation signal from the monitor device 70 (Step S110).

Next, when the operator operates the operation lever 13 of the operation device 12 to conduct striking work by the hydraulic breaker, the operation signal is input to the controller 71. The computing section 71*b* of the controller 71 computes the current value using the operation signal and the read map depicted in FIG. 4 and the map depicted in FIG. 6 (Step S130), and the controller 71 outputs the magnetizing current corresponding to the current value to the proportional solenoid 51*a* or 51*b* of the flow control valve 51 of the attachment flow rate regulation valve device 40. The stroke (opening area) of the flow control valve 51 is thereby controlled, the hydraulic fluid at the flow rate corresponding to the flow rate computed by the map of FIG. 4 is supplied to the actuator 60, and the hydraulic breaker is driven.

3. Case in Which Attachment is Crusher

After replacing an attachment by the crusher, the operator operates the operation keys on the input device 70*b* to set the attachment mode (Step S100). Next, when the operator operates the operation keys on the input device 70*b* of the monitor device 70 while viewing the display section 70*a* thereof to select the hydraulic breaker from the attachment list, and depresses the execution key, the computing section 71*b* of the controller 71 reads the crusher 1 map and crusher 2 map depicted in FIGS. 5A and 5B and corresponding to the crusher from the storage section 71*c* on the basis of the attachment designation signal from the monitor device 70 (Step S110).

Next, when the operator operates the operation lever 13 of the operation device 12 to conduct crushing work by the crusher, the operation signal is input to the controller 71. The computing section 71*b* of the controller 71 computes the current value using the operation signal and the read maps depicted in FIGS. 5A and 5B and the map depicted in FIG. 6 (Step S140), and the controller 71 outputs the magnetizing current corresponding to the current value to the solenoid proportional pressure reducing valves 81*a* and 81*b* of the flow control valve 5 of the control valve 3 and the proportional solenoid 51*a* or 51*b* of the flow control valve 51 of the attachment flow rate regulation valve device 40. The flow control valve 5 is thereby operated to the full open position and the stroke (opening area) of the flow control valve 51 is thereby controlled, the hydraulic fluid at the flow rate corresponding to the flow rate computed by the map of FIG. 5A and the hydraulic fluid at the flow rate corresponding to the flow rate computed by the map of FIG. 5B are merged together, the merged hydraulic fluid at the sum of the flow rates is supplied to the actuator 60, and the crusher is driven.

Next, the maximum demanded flow rate for each attachment varies depending on a manufacturer or specifications even with the same type of the attachment, so that there are cases in which the hydraulic drive system is unable to handle a difference in the maximum demanded flow rate depending on the manufacturer or specifications only by the maps stored in the storage section 71*c* of the controller 71 in advance. In the present embodiment, to respond to such needs, the monitor device 70 also plays a role as a maximum flow rate regulation device that regulates a set maximum flow rate in each map, and the computing section 71*b* of the controller 71 changes the set maximum flow rate in each map stored in the storage section 71*c* on the basis of an instruction from the maximum flow rate regulation device, rewrites the set maximum flow rate to a new set maximum flow rate, and stores the new set maximum flow rate in the storage section 71*c*. Details of the maximum flow rate regulation device will be described below.

The input device 70*b* of the monitor device 70 includes operation keys 70*b*1 and 70*b*2 for increasing and reducing the set maximum flow rate in each map by a unit amount.

Figure 8A:
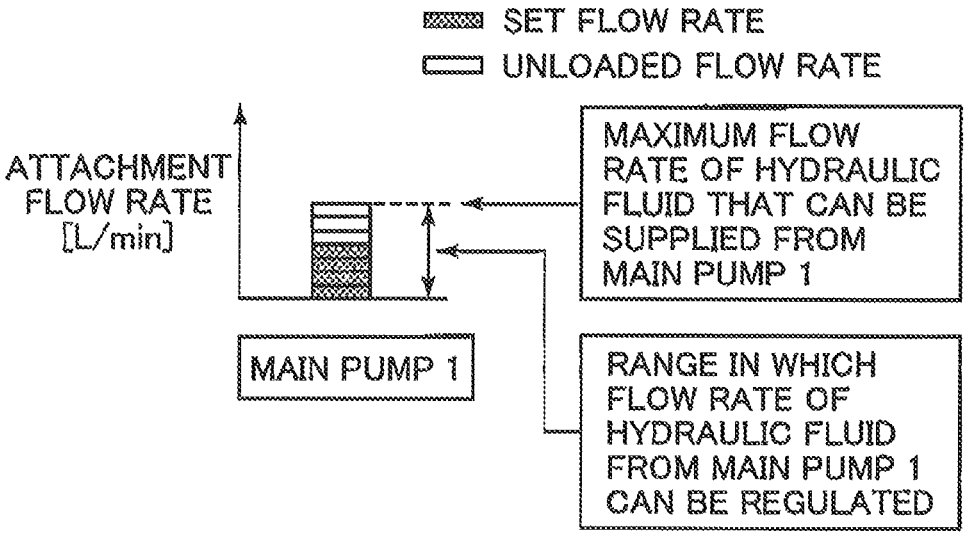
FIG. 8A depicts a concept of regulating a set maximum flow rate in a case in which an actuator for the attachment such as the rotary tilt bucket or the hydraulic breaker is driven by a hydraulic fluid delivered only from on main pump.

FIG. 8A depicts a concept of regulating a set maximum flow rate in a case in which the actuator for the attachment such as the rotary tilt bucket or the hydraulic breaker is driven by the hydraulic fluid delivered only from the main pump 1.

In a case in which the attachment is, for example, the rotary tilt bucket and the operator regulates the set maximum flow rate (for example, Qmax1 of FIG. 3) of the hydraulic fluid supplied to the actuator (actuator 60, for example) for the rotary tilt bucket, the operator first operates the operation keys on the input device 70*b* of the monitor device 70 while viewing the display section 70*a* thereof to select a flow rate regulation mode from the mode list displayed on the display section 70*a*, and depresses the execution key. The computing section 71*b* of the controller 71 then sets the flow rate regulation mode in which the set maximum flow rate of the hydraulic fluid supplied to the actuator 60 can be regulated. Next, the operator operates the operation keys on the input device 70*b* of the monitor device 70 while viewing the display section 70*a* thereof to select the rotary tilt bucket as the attachment from the attachment list displayed on the display section 70*a*, and depresses the execution key. The computing section 71*b* of the controller 71 then displays a maximum flow rate regulation screen for the rotary tilt bucket as depicted in FIG. 8A on the display section 70*a* of the monitor device 70 on the basis of the attachment designation signal.

Next, the operator performs an operation of depressing the operation key 70*b*1 or 70*b*2 on the input device 70*b* of the monitor device 70 while viewing the screen displayed on the display section 70*a* thereof. For example, when the operator depresses the operation key 70*b*1 of the input device 70*b* once, a signal corresponding to a unit increase value $+\Delta Q2$ is output from the input device 70*b* to the controller 71. When the operator depresses the operation key 70*b*1 twice, a signal corresponding to $+2\Delta Q2$ is output to the controller 71. When the operator depresses the operation key 70*b*1 three times, a signal corresponding to $+3\Delta Q2$ is output to the controller 71. Conversely, when the operator depresses the operation key 70*b*2 of the input device 70*b* once, a signal corresponding to a unit reduction value $-\Delta Q2$ is output from the input device 70*b* to the controller 71. When the operator depresses the operation key 70*b*2 twice, a signal corresponding to $-2\Delta Q2$ is output to the controller 71. When the operator depresses the operation key 70*b*2 three times, a signal corresponding to $-3\Delta Q2$ is output to the controller 71.

The computing section 71*b* of the controller 71 to which such an increase or reduction signal is input from the input device 70*b* increases or reduces the set maximum flow rate of the hydraulic fluid delivered from the main pump 1 on the maximum flow rate regulation screen depicted in FIG. 8A per unit flow rate and, at the same time, increases or reduces and rewrites the set maximum flow rate Qmax1 in the map for the rotary tilt bucket stored in the storage section 71*c* and depicted in FIG. 3.

After regulation of the set maximum flow rate Qmax1 in this way, the operator sets the attachment mode, designates the rotary tilt bucket as the attachment, and then operates the operation lever 13 of the operation device 12. A magnetizing current corresponding to the new set maximum flow rate Qmax1 related to the actuator (actuator 60, for example) for the rotary tilt bucket is output from the controller 71 to the proportional solenoid 51*a* or 51*b*. The proportional solenoid 51*a* or 51*b* is thereby actuated and a maximum opening area of the flow control valve 51 is changed. In response to this changed maximum opening area, the flow rate of the hydraulic fluid supplied from the main pump 1 to the attachment flow rate regulation valve device 40 via the control valve 3 is controlled to be equal to the flow rate regulated by operating the operation key 70*b*1 or 70*b*2 on the input device 70*b* described above, the flow rate of the hydraulic fluid supplied to the actuator 60 for the rotary tilt bucket can be regulated to an operator's intended flow rate, and the hydraulic fluid at an unnecessary flow rate is unloaded from the unloading valve 55 to a hydraulic fluid tank.

Figure 8B:
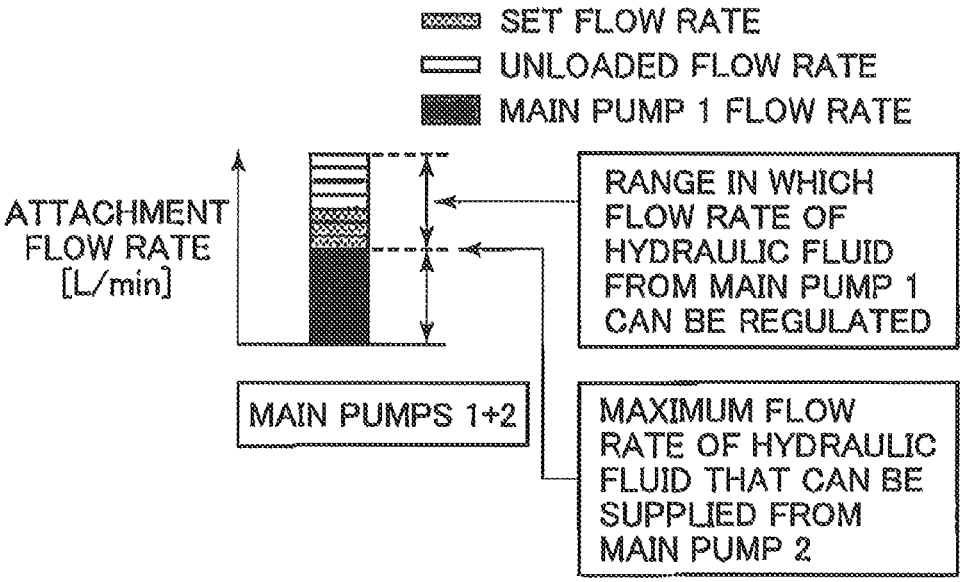
FIG. 8B depicts a concept of regulating the set maximum flow rate in a case in which the hydraulic fluid delivered only from one main pump is insufficient to supply the hydraulic fluid at the maximum demanded flow rate for the attachment such as the crusher.

FIG. 8B depicts a concept of regulating the set maximum flow rate in a case in which the hydraulic fluid delivered only from the main pump 1 is insufficient to supply the hydraulic fluid at the maximum demanded flow rate for the attachment such as the crusher. In this case, as described above, the hydraulic fluid at the (fixed) delivery flow rate delivered from the main pump 2 is entirely supplied to the actuator 60 and the flow rate of the hydraulic fluid supplied from the main pump 1 is regulated.

First, the operator sets the flow rate regulation mode as described above and selects the crusher as the attachment. The computing section 71*b* of the controller 71 then displays a maximum flow rate regulation screen for the crusher as depicted in FIG. 8B on the display section 70*a* of the monitor device 70.

Next, the operator performs an operation of depressing the operation key 70*b*1 or 70*b*2 on the input device 70*b* of the monitor device 70 while viewing the screen displayed on the display section 70*a* thereof. A signal corresponding to a unit increase value $+n\Delta Q3$ or a unit reduction value $-n\Delta Q3$ is output from the monitor device 70 to the controller 71, and the computing section 71*b* of the controller 71 can increase or reduce and rewrite the set maximum flow rate Qmax32 in the crusher 2 map depicted in FIG. 5B and stored in the storage section 71*c*.

After regulation of the set maximum flow rate Qmax32 in this way, the operator sets the attachment mode, designates the crusher as the attachment, and then operates the operation lever 13 of the operation device 12. A magnetizing current corresponding to the new set maximum flow rate Qmax32 related to the actuator (actuator 60, for example) for the crusher is output from the controller 71 to the proportional solenoid 51*a* or 51*b*. The proportional solenoid 51*a* or 51*b* is thereby actuated and the maximum opening area of the flow control valve 51 is changed. In response to this changed maximum opening area, the flow rate of the hydraulic fluid supplied from the main pump 1 to the actuator (actuator 60) of the crusher via the control valve 3 and the attachment flow rate regulation valve device 40 is controlled to be equal to the flow rate regulated by operating the operation key 70*b*1 or 70*b*2 on the input device 70*b* described above. On the other hand, as described above, the flow control valve 5 of the control valve 3 is operated to the full open position, the hydraulic fluid delivered from the main pump 2 is entirely merged with the hydraulic fluid delivered from the main pump 1 controlled by the flow control valve 51, and the merged hydraulic fluid is supplied to the actuator (actuator 60) for the crusher. The flow rate of the hydraulic fluid supplied to the actuator (actuator 60) for the crusher can be thereby regulated to an operator's intended flow rate and the hydraulic fluid at an unnecessary flow rate is unloaded from the unloading valve 55 to the hydraulic operating fluid tank.

The present embodiment configured as described so far obtains the following effects.

1. The plurality of maps setting the different maximum flow rates depending on the types of the attachments are stored in the storage section 71*c* of the controller 71, and the set maximum flow rate of the hydraulic fluid supplied to each attachment is regulated only by operator's operating the input device 70*b* of the monitor device 70 to designate the type of the attachment. It is, therefore, possible to regulate the set maximum flow rate at the time of replacement of the attachment easily in a short period of time, instantly adapt to the replacing attachment, and perform the replacement of the attachment including the regulation of the set maximum flow rate promptly and easily.

2. The hydraulic drive system is configured such that a special throttle is not installed in the hydraulic line 50 of the attachment flow rate regulation valve device 40 and that the unloading valve 55 unloads the hydraulic fluid flowing in the hydraulic line, maintains the differential pressure across the flow control valve 51, and controls the flow rate. Thus, in a case in which the maximum flow rate of the hydraulic fluid supplied to the actuator 60 for the attachment such as the rotary tilt bucket is sufficient to be approximately half of the maximum delivery flow rate of the hydraulic fluid delivered from the main pump 1, the hydraulic fluid discharged from the actuator 60 is merely returned to the tank by way of the flow control valve 51, the load pressure of the main pump 1 does not increase without generation of an unnecessary back pressure, and the energy conservation performance is not deteriorated. Furthermore, in a case in which the actuator 60 for the attachment such as the hydraulic breaker requires the flow rate that is approximately equal to the maximum delivery flow rate of the hydraulic fluid delivered from the main pump 1, the hydraulic fluid supplied from the main pump 1 passes through the flow control valve 51 (full open) of the attachment flow rate regulation valve device 40 and is only supplied to the actuator 60. In this case, an unnecessary throttle pressure loss is not generated and the energy conservation performance can be improved.

3. In addition to the main pump 1 (first hydraulic pump) and the center bypass type flow control valve 4 (first selector valve), the main pump 2 (second hydraulic pump) and the center bypass type flow control valve 5 (second selector valve) are provided, the hydraulic fluid supplied from the main pump 2 and passing through the flow control valve 5 is merged with the hydraulic fluid supplied from the main pump 1 by way of the flow control valve 4 and the attachment flow rate regulation valve device 40, and the merged hydraulic fluid can be supplied to the actuator 60 for the attachment. When the maximum demanded flow rate for the attachment is higher than the maximum delivery flow rate of the hydraulic fluid delivered from the main pump 1, then the position of the flow control valve 51 of the attachment flow rate regulation valve device 40 is switched over from the neutral position and, at the same time, the position of the flow control valve 5 is switched over to the full open position. Thus, the flow rate of the hydraulic fluid that can be supplied to the actuator 60 can be switched over among three stages, that is, the flow rate which is part of (for example, half of) the flow rate of the hydraulic fluid delivered from the main pump 1, generally entirety of the flow rate of the hydraulic fluid delivered from the main pump 1, and part of or entirety of the flow rate of the hydraulic fluid delivered from the main pump 1 and entirety of the flow rate of the hydraulic fluid delivered from the main pump 2. Even if the number of types of the attachments is three or more (for example, the rotary tilt bucket, the hydraulic breaker, and the crusher), it is possible to regulate the set maximum flow rate at the time of the replacement of the attachment easily in a short period of time.

4. The operator operates the input device 70*b* of the monitor device 70 to instruct the regulation of the set maximum flow rate in any of the maps, the set maximum flow rate in the map being lower than the maximum delivery flow rate of the hydraulic fluid delivered from the main pump 1, thereby changing the set maximum flow rate in the map, rewriting the set maximum flow rate to the new set maximum flow rate, and storing the new set maximum flow rate. It is, therefore, possible for the operator to arbitrarily set and regulate the maximum flow rate of the hydraulic fluid supplied to the actuator 60 for the attachment. Thus, even in the case in which the maximum demanded flow rate for the attachment of the same type varies depending on the manufacturer or the specifications, the hydraulic drive system can promptly respond to the difference in the maximum demanded flow rate for the attachment and operability of attachment work can be improved.

5. The attachment flow rate regulation valve device 40 regulates the flow rate of only the hydraulic fluid supplied from the main pump 1 out of a plurality of pumps, compared with a case in which the attachment flow rate regulation valve device 40 regulates flow rates of all the hydraulic fluids delivered from the plurality of pumps. Thus, outer shapes of the flow control valve 51 and the unloading valve 55 of the attachment flow rate regulation valve device 40 and a magnitude of a spool diameter can be made compact, and a weight of the attachment flow rate regulation valve device 40 is reduced. It is, therefore, possible to manufacture the hydraulic excavator at a low cost.

6. In the hydraulic drive system using the center bypass type control valve 3, the flow rate of the hydraulic fluid supplied to the actuator 60 is divided into the flow rate responsible for the main pump 1 and that responsible for the main pump 2. It is thereby possible to reduce the unnecessary flow rate (unloaded flow rate) of the hydraulic fluid that is generated when the attachment flow rate regulation valve device 40 regulates the flow rate and that is not supplied to the actuator 60 for the attachment. In this respect, it is possible to improve the energy conservation performance and improve work efficiency and fuel efficiency.

While the hydraulic drive system is configured such that the hydraulic fluid delivered from the main pump 2 is supplied to the actuator 60 on a route different from a route of the attachment flow rate regulation valve device 40 via the actuator lines 10*a* and 10*b* in the embodiment, the hydraulic drive system may be configured such that the hydraulic fluids delivered from the main pumps 1 and 2 are merged together, the merged hydraulic fluid is supplied to the attachment flow rate regulation valve device 40, and the hydraulic fluid at the regulated flow rate is supplied to the actuator 60. Furthermore, the hydraulic drive system may be configured such that one main pump that can deliver a hydraulic fluid at the maximum delivery flow rate corresponding to those of the hydraulic fluids delivered from the two pumps is provided as an alternative to providing the two main pumps, the hydraulic fluid delivered from this main pump is supplied to the attachment flow rate regulation valve device 40, and the hydraulic fluid at the regulated flow rate is supplied to the actuator 60. In this case, it is possible to obtain the effects 1 and 2 described above by a flow rate regulation function of the attachment flow rate regulation valve device 40.

Moreover, while the first and second selector valves of the control valve 3 are the flow control valves in the embodiment described above, the first and second selector valves may be simple selector valves each having the neutral position and the full open position.

Furthermore, while the operation device 12 is the electric lever type operation device in the embodiment described above, the operation device 12 may be an operation device of a pilot valve type that generates a hydraulic pilot pressure in response to the operation amount of the operation lever 13. In this case, detecting the hydraulic pilot pressure by a pressure sensor and inputting the detected hydraulic pilot pressure to the controller 71 enables the operation device 12 to operate similarly to the electric lever type operation device.

Moreover, while the monitor device 70 is used as the attachment designation device that designates the type of the attachment and the maximum flow rate regulation device that instructs the regulation of the set maximum flow rate in the map in the embodiment described above, a dedicated attachment designation device and a dedicated maximum flow rate regulation device may be provided.

Furthermore, while the position of the flow control valve 51 of the attachment flow rate regulation valve device 40 is switched over by the proportional solenoids 51*a* and 51*b* in the embodiment described above, the flow control valve 51 may be a valve of a hydraulic pilot switching type provided with a pilot pressure receiving section on each end of a spool. In this case, similarly to the flow control valve 5, a solenoid proportional pressure reducing valve lies in a hydraulic line that introduces a hydraulic pilot pressure to each pressure receiving section and the solenoid proportional pressure reducing valve is controlled by a magnetizing current from the controller 71, whereby the flow control valve 51 can operate similarly to the case of providing the proportional solenoids 51*a* and 51*b*.

Moreover, while the operation detection valve 56, the signal pressure line 57, and the fixed throttle 58 configure the operation switching device 59 that switches over the position of the flow control valve 4 (first selector valve) to the full open position when the operation device 12 is operated in the embodiment described above, the position of the flow control valve 4 (first selector valve) may be switched over to the full open position by causing a solenoid selector valve to lie in the signal pressure line 57 and switching over a position of the solenoid selector valve in response to a signal from the controller 71.

What is claimed is:

1. A construction machine including:

a first hydraulic pump;

a first selector valve of a center bypass type to which a hydraulic fluid delivered from the first hydraulic pump is introduced;

an actuator for an attachment, the actuator being driven by the hydraulic fluid having passed through the first selector valve; and an operation device that instructs an operation of the attachment, wherein the construction machine comprises:

an attachment flow rate regulation valve device having a hydraulic line connected to the first selector valve, a flow control valve of a closed center type connected to the hydraulic line and configured to regulate a flow rate of the hydraulic fluid passing through the first selector valve and supply the hydraulic fluid to the actuator, and an unloading valve connected to the hydraulic line and configured to unload the hydraulic fluid flowing through the hydraulic line while maintaining a differential pressure across the flow control valve;

an attachment designation device that designates a type of the attachment;

an operation switching device configured to switch over a position of the first selector valve to a full open position when the operation device is operated; and a controller configured to control the flow control valve on the basis of an operation signal output from the operation device and an attachment designation signal output from the attachment designation device, the unloading valve being a selector valve that moves between a closed position and an open position, the selector valve having, at an end portion of a side in which the unloading valve is actuated in a closing direction, a pressure receiving section to which a load pressure of the actuator is introduced and a spring, and having, at an end portion of a side in which the unloading valve is actuated in an opening direction, a pressure receiving section to which a pressure from the hydraulic line is introduced, the controller being configured to select a corresponding map in response to the attachment designation signal from maps which are stored in the controller and each of which sets a relationship between the operation signal per type of the attachment and the flow rate of the hydraulic fluid supplied to the actuator, to generate a control signal by causing the selected map to refer to the operation signal, and to control the flow control valve in such a manner that a position of the flow control valve is switched over from a neutral position on the basis of the control signal.

2. The construction machine according to claim 1, further comprising:

a second hydraulic pump;

a second selector valve of a center bypass type to which a hydraulic fluid delivered from the second hydraulic pump is introduced; and an actuator line that merges the hydraulic fluid passing through the second selector valve with the hydraulic fluid supplied from the flow control valve and supplies a merged hydraulic fluid to the actuator, wherein the controller is configured to switch over the position of the flow control valve from the neutral position and a position of the second selector valve to a full open position when a maximum demanded flow rate for the attachment designated by the attachment designation signal is higher than a maximum delivery flow rate of the hydraulic fluid delivered from the first hydraulic pump.

3. The construction machine according to claim 1, further comprising a maximum flow rate regulation device configured to regulate a maximum flow rate set in any one of the maps that is lower than a maximum delivery flow rate of the hydraulic fluid delivered from the first hydraulic pump, wherein the controller is configured to change the set maximum flow rate in the map on the basis of an input from the maximum flow rate regulation device and stores the changed set maximum flow rate.

* * * * *